US010871125B2

(12) United States Patent
Laqua

(10) Patent No.: US 10,871,125 B2
(45) Date of Patent: Dec. 22, 2020

(54) OPTIMIZED HUB SUPPORT

(71) Applicant: KS Kolbenschmidt GmbH, Neckarsulm (DE)

(72) Inventor: Matthias Laqua, Bad Wimpfen (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 69 days.

(21) Appl. No.: 15/772,205

(22) PCT Filed: Nov. 2, 2016

(86) PCT No.: PCT/EP2016/076458
§ 371 (c)(1),
(2) Date: Apr. 30, 2018

(87) PCT Pub. No.: WO2017/076920
PCT Pub. Date: May 11, 2017

(65) Prior Publication Data

US 2018/0313293 A1 Nov. 1, 2018

(30) Foreign Application Priority Data

Nov. 2, 2015 (DE) ..... 10 2015 221 370

(51) Int. Cl.
*F02F 3/00* (2006.01)
*F02F 3/22* (2006.01)

(52) U.S. Cl.
CPC ..... *F02F 3/0023* (2013.01); *F02F 3/22* (2013.01)

(58) Field of Classification Search
CPC ..... F02F 3/0023; F02F 3/22
See application file for complete search history.

(56) References Cited

U.S. PATENT DOCUMENTS 3,915,141 A 10/1975 Ottl et al.
4,581,983 A * 4/1986 Moebus ..... B23K 35/004 123/193.6
6,477,941 B1 * 11/2002 Zhu ..... F02F 3/003 92/186
6,588,320 B2 * 7/2003 Gaiser ..... B23P 15/10 92/231
6,840,155 B2 * 1/2005 Ribeiro ..... B21K 1/18 92/186
2006/0005701 A1 * 1/2006 Huang ..... B21K 1/18 92/186
2011/0041684 A1 * 2/2011 Kortas ..... F02F 3/0023 92/255

(Continued)

FOREIGN PATENT DOCUMENTS

DE 10 2006 055251 A1 5/2008
EP 0373689 A1 * 6/1990 ..... F02F 3/0023

(Continued)

*Primary Examiner* — Hung Q Nguyen
(74) *Attorney, Agent, or Firm* — Young Basile Hanlon & MacFarlane, P.C.

(57) ABSTRACT

A piston for an internal combustion engine including an upper part and a lower part connected by at least one threaded connection. The lower part includes a cutout positioned in the inner region of the piston above a peak of the pin bore extending toward the outer periphery of the piston. The lower part further includes at least one web positioned above the pin bore extending toward the outer periphery of the piston.

18 Claims, 6 Drawing Sheets

(56) References Cited

U.S. PATENT DOCUMENTS

| | | | | |
|---|---|---|---|---|
| 2012/0000439 | A1* | 1/2012 | Scharp | F02F 3/003<br>123/193.6 |
| 2012/0260869 | A1 | 10/2012 | Freidhager | |

FOREIGN PATENT DOCUMENTS

| | | | |
|---|---|---|---|
| GB | 2 366 607 | A | 3/2002 |
| JP | S59 168556 | U | 11/1984 |
| WO | 2007/068222 | A1 | 6/2007 |
| WO | 2011/072657 | A1 | 6/2011 |

* cited by examiner

OPTIMIZED HUB SUPPORT

TECHNICAL FIELD

The invention concerns a piston assembled from an upper part, which has a cooling channel, and a lower part, which has a pin bore, wherein the upper part and the lower part have mutually facing contact surfaces and the two parts are held together by means of at least one threaded connection.

BACKGROUND

Such assembled pistons, also called large bore pistons, are known. An upper part of such a piston is produced separately from a lower part of the piston in the same or different processes and from the same or different materials, and the two parts are assembled via mutually facing contact surfaces, wherein the permanent connection between the two parts takes place by means of at least one threaded connection.

These pistons are used in internal combustion engines for example for locomotives, ships and similar, and have very large dimensions compared with pistons used for example for internal combustion engines of cars. Accordingly, not only is the load high but the weight is also high because of the size of the piston.

SUMMARY

The invention is therefore based on the object of providing a piston, in particular a large bore piston, for internal combustion engines in which, while retaining the necessary strength, the weight is reduced in order to meet the requirements of the internal combustion engine.

According to the invention, it is provided that the lower part, starting from its inner region above a peak of the pin bore, has a cutout oriented in the direction of an outer periphery, and starting from an outer region, has at least one web above the pin bore and also pointing in the direction of the outer periphery. According to the invention, in this piston, material has been removed from its inner region, at a specific location and in a targeted fashion, in order to save weight. This removal of material takes place at locations at which the loads on the piston, from the compression forces in operation of the internal combustion engine, are reduced. In particular, material is removed in the inner region of the pistons, in pistons in which the upper part has a contact surface for the lower part, and the lower part has a corresponding contact surface for the upper part. It is however also conceivable that more than one, in particular circumferential, contact surface is provided. Since, because of the deformation of the upper part under the compression forces, the lower part is weakened by the cutout (removal of material), according to the invention it is furthermore provided that a web is provided above the pin bore, and also pointing in the direction of the outer periphery. This at least one web, running parallel to the piston stroke axis, supports the underside of the upper part directly. Alternatively, it is provided that on its upper edge, the lower part has a circumferential web, wherein the web arranged above the peak of the pin bore is oriented perpendicular thereto.

According to the invention, by the reduction of material, weight is saved by production of the cutout in the inner region of the lower part of the piston, and at the same time the strength is increased by a web on the outside above the pin bore.

In a refinement of the invention, a single web is provided above the peak of the pin bore. Whereas, alternatively, it is conceivable also to provide for example two webs running parallel to each other and spaced apart, a single web is of particular advantage because, firstly, it guarantees the necessary support of the upper part in precisely the region in which its greatest deformation occurs, and secondly it does not increase the weight further compared with a piston without such a web, in order to achieve the weight reduction by the cutout in the inner region of the lower part of the piston.

In a refinement of the invention, next to the at least one web, at least one cutout is made in the lower part. Such a further cutout has the advantage that at such locations around the pin bore, (pin hub) material is removed which does not or not substantially weaken the strength of the lower part. By the combination of the web and cutout next to the web, thus further material can be reduced while retaining the necessary strength.

In a refinement of the invention, the cutout in the inner region of the piston transforms via a rounded region into the inner region of the lower part. In this way, sharp-edged transitions from the inner region to the cutout are effectively avoided, so that crack formations in these regions in operation of the piston in the internal combustion engine are effectively avoided.

In a refinement of the invention, above the cutout in its inner region, the upper part has a passage opening in the direction of an inner region lying inside the upper part. This passage opening may serve for example for spraying cooling oil into the inner region inside the upper part. It is also conceivable that a connection is created from the cooling channel to this inner region inside the upper part, in order to obtain an exchange of cooling oil between the circumferential, annular cooling channel lying behind a ring field and the inner region inside the upper part. Here again, it is advantageous if the cutout in the inner region of the lower part transforms preferably in a rounded fashion into said passage opening, in order to save further material and avoid crack formations.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The invention is explained and described below in more detail with reference to figures.

Figure 1:
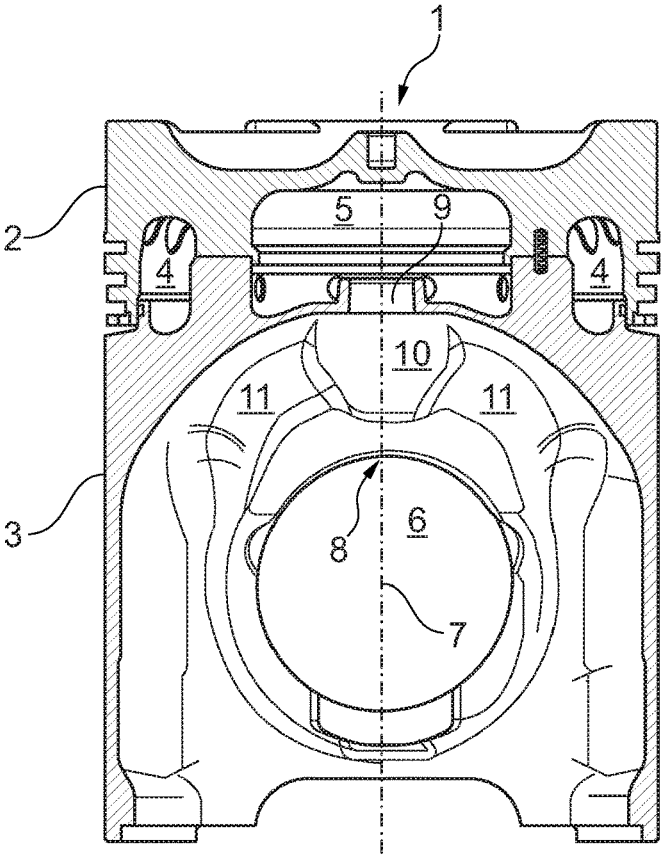
FIGS. 1 to 6 show an exemplary embodiment of the piston 1 in various views and depictions (schematic depiction and three-dimensional depiction).
Figure 2:
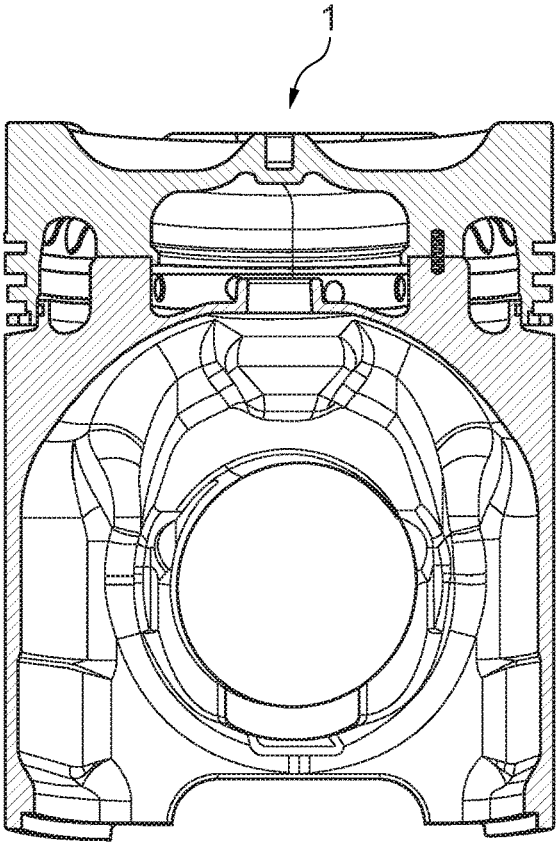
Figure 3:
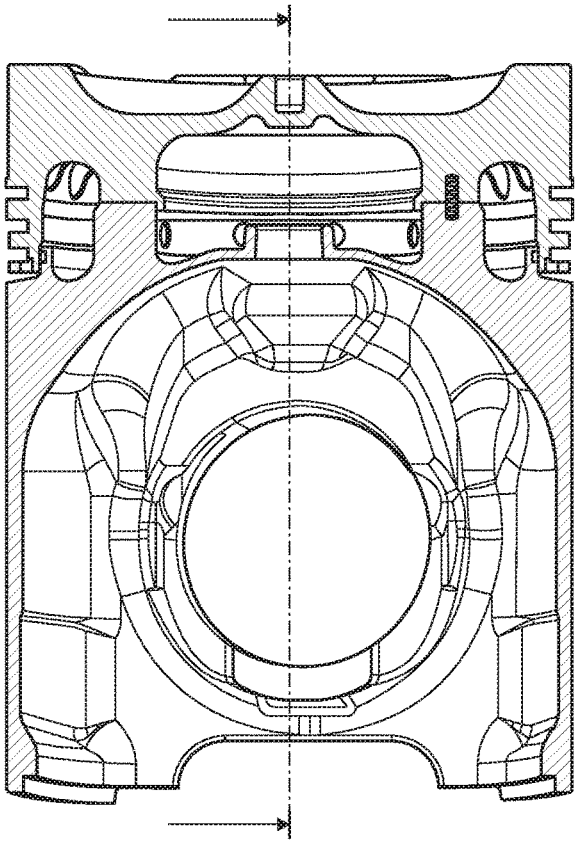

FIGS. 1 to 6 show an exemplary embodiment of the piston 1 in various views and depictions (schematic depiction in FIG. 1 and three-dimensional depiction in FIG. 2). The piston 1 has an upper part 2 and a lower part 3. The upper part 2 is configured in a known fashion and has at least one ring field (here with three ring grooves), and for example a combustion chamber dish, valve pockets and similar. The assembly of the upper part 2 with the lower part 3 creates a cooling channel 4, for which the two parts 2, 3 have corresponding annular cutouts open towards the bottom and towards the top respectively. Reference sign 5 designates an inner region which is also produced by assembly of the two parts 2, 3.

The lower part 3 has a pin bore 6 (with pin hub surrounding this and not shown in more detail). A piston stroke axis 7 runs through a pin axis of the pin bore 6 (not designated in detail), wherein reference sign 8 designates an upper peak of the pin bore 6. Also, the lower part 3 has a passage opening 9 oriented in the direction of the inner region 5, and a piston skirt and further elements known in themselves for performing the function of the lower part 3 of the piston 1.

According to the invention, in its inner region, the lower part 3 has a first cutout 10 arranged above the peak 8 of the pin bore 6. As very clearly evident from FIGS. 1 to 4, the first cutout 10 starts from the inner region of the lower part 3, in the direction of the outer periphery of the piston 1, without creating an opening in the direction of the outer periphery. In the exemplary embodiment according to FIGS. 1 to 6, the first cutout 10 advantageously has the shape shown, wherein the edge regions of the first cutout 10 transform via a rounded transition 11 into the inner region of the lower part 3.

Figure 4:
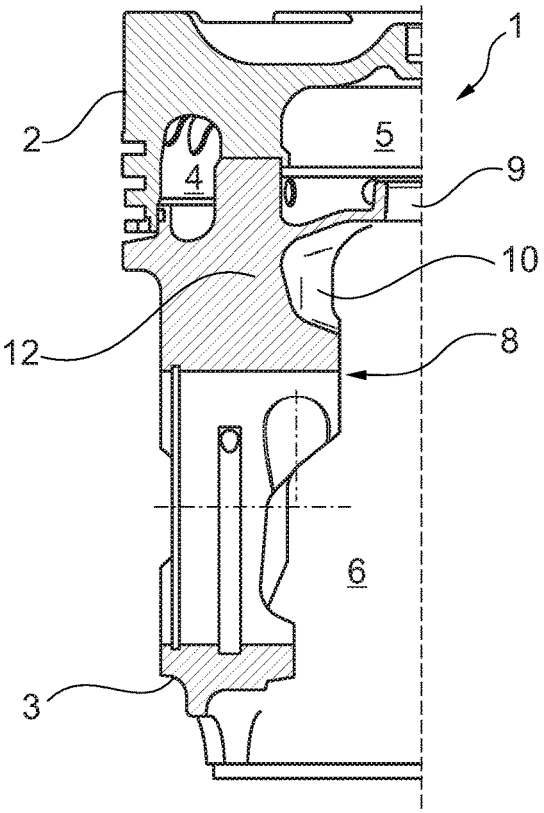

With reference to FIG. 4, it is pointed out that the upper part 2 is connected (bolted) to the lower part 3 by means of a threaded connection 12. The threaded connection 12 is merely indicated in FIG. 4 for the sake of completeness, so that a passage opening in the lower part 3, for a bolt which is guided through this opening from below and screwed into a corresponding thread in the upper part 2, is not shown in detail but is present. This threaded connection 12 occurs multiple times, but at least twice, distributed over the periphery.

Figure 5:
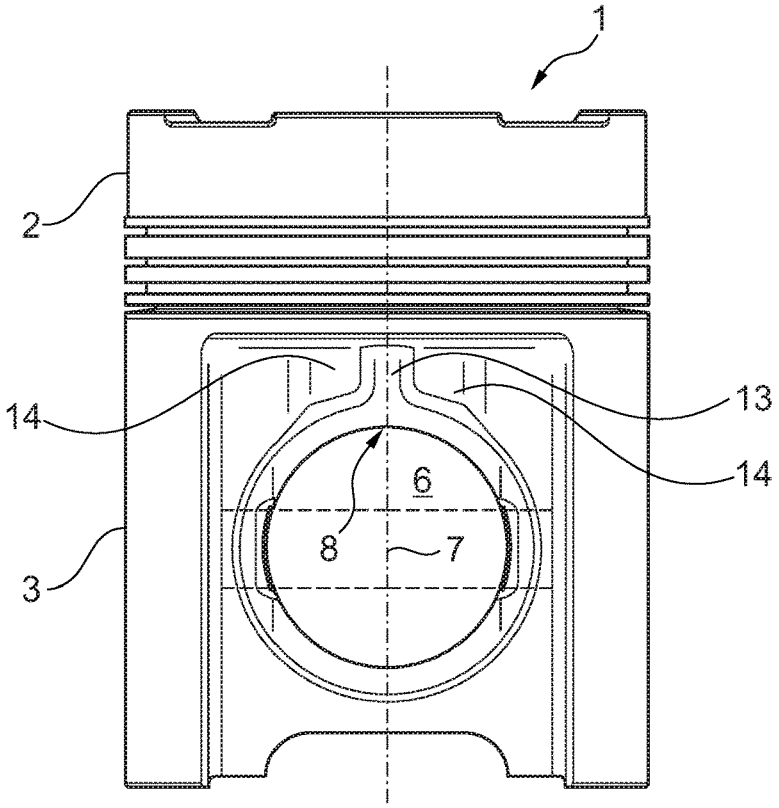
Figure 6:
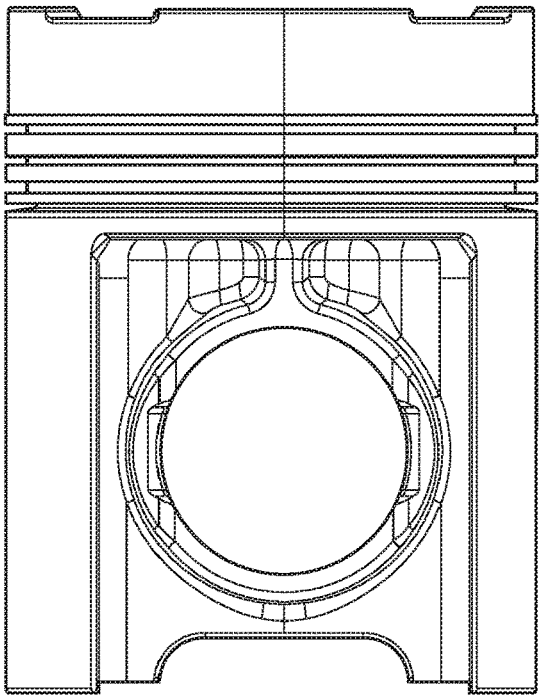

FIG. 5 shows a web 13 corresponding to the first cutout or recess 10 and also arranged above the peak 8 of the pin bore 6. This web 13 protrudes from the surface of the pin hub around the pin bore 6. For further weight reduction, a second cutout 14 is provided next to the web 13 (either only to the right or only to the left thereof or on both sides). To avoid crack formations, the web 13 again transforms in rounded fashion into the base of the second cutout 14 or into the corresponding regions of the pin hub. The upper end of the web 13 may either rest directly on the underside of the upper part 2, wherein it is evident from FIG. 5 that the lower part 3 has an arcuate web portion at its upper end between the two side edges of the piston skirts, which portion supports the web 13. This arcuate web portion between the two side edges of the piston skirts gives an improved force transfer and force distribution from the upper part 2 into the lower part 3 via the at least one web 13.

Figure 7:
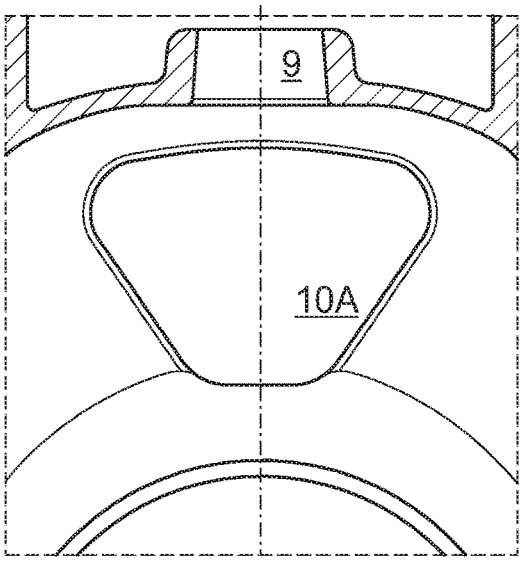
FIGS. 7 to 9 show a first exemplary embodiment of the shape of the cutout 10.
Figure 8:
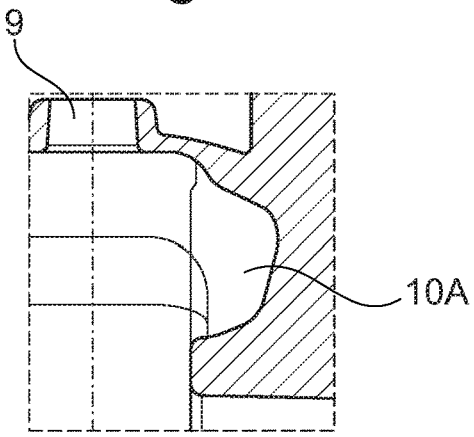
Figure 9:
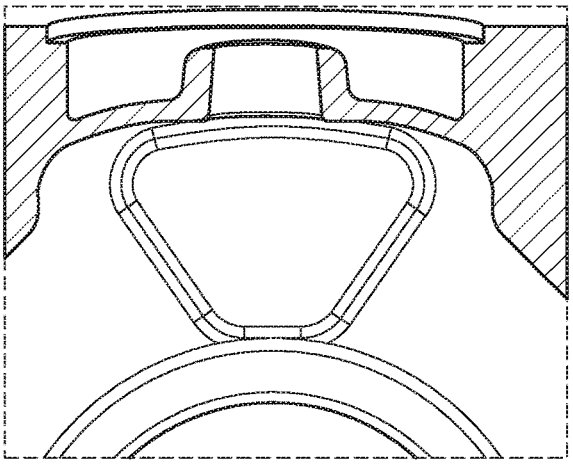

FIGS. 7 to 9 show a first exemplary embodiment of the shape of the first cutout 10.

The position of the first cutout 10A in the lower part 3 is also clearly evident. Reference is made in particular to FIG. 8 which shows that the first cutout 10A extends from the inner region of the lower part 3 in the direction of the outer periphery of the piston 1 (when viewing FIG. 8, the right-hand end of the hatched region).

Figure 10:
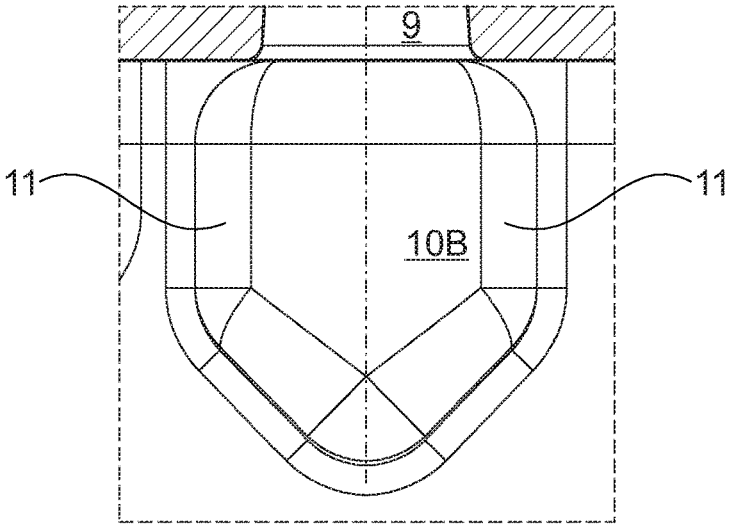
FIGS. 10 to 12 show a further configuration of the cutout 10.
Figure 11:
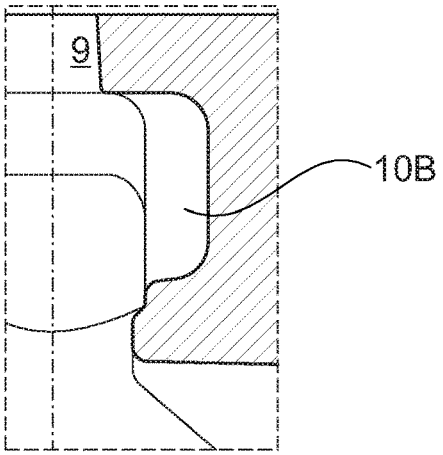
Figure 12:
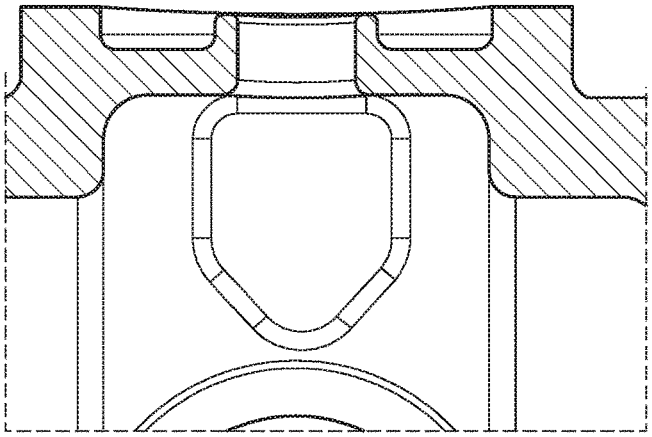

A further configuration of the first cutout 10 is shown in FIGS. 10 to 12. Here it is evident above all that the first cutout 10B transforms via a rounded transition 11 into the inner region of the lower part 3.

Evidently, other forms of first cutout 10 than those shown in FIGS. 7 and 10 are also conceivable. Similarly, a rounded transition 11 may also be provided for the first cutout 10 according to FIGS. 7 to 9.

Figure 13:
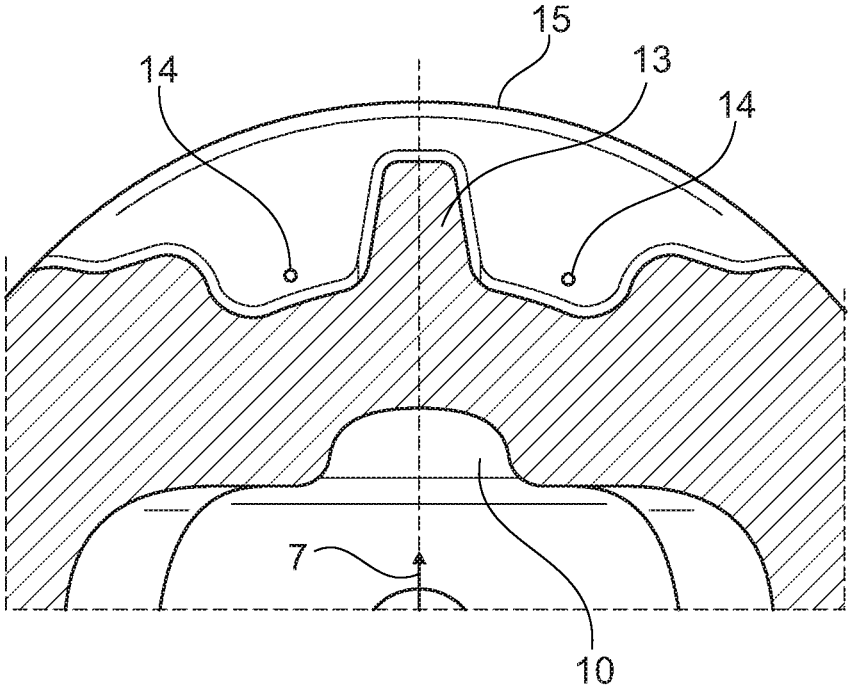
FIGS. 13 and 14 show the interaction of the cutout 10 and the web 13.
Figure 14:
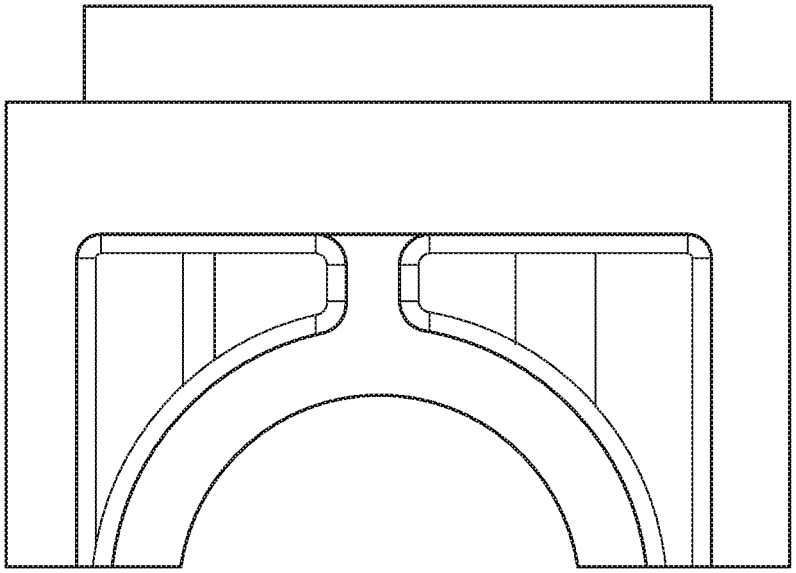

FIGS. 13 and 14 clearly show the interaction of the cutout 10 and the web 13. When viewing FIG. 13 in particular, it is clear that the lower part 3 comprises, starting from its inner region above the peak 8 of the pin bore 6, the cutout 10 oriented in the direction of an outer periphery 15, and starting from an outer region (upper region of the pin hub), at least the web 13 above the pin bore 6 and also pointing in the direction of the outer periphery 15. It is also clearly evident that a second cutout 14 is also provided around the web 13.

FIG. 14 shows again the lower part 3 in a three-dimensional depiction, wherein the upper part of this FIG. 14 very clearly shows that the lower part 3 has a shoulder which forms a contact surface for the upper part 2.

For the sake of completeness, it is pointed out that because of the rotationally symmetrical form of the piston 1, the first cutout 10 and the corresponding web 13 according to the invention (as shown for example in FIG. 13) are each also present mirror-symmetrically on both sides of the piston stroke axis 7, i.e. for each pin bore 6. Accordingly, the term "pin bore" means each bore in the lower part 3 in which one end of a piston pin is arranged, and the intermediate region of which receives the small end of the connecting rod.

LIST OF REFERENCE SIGNS

1. Piston
2. Upper part
3. Lower part
4. Cooling channel
5. Inner region
6. Pin bore
7. Piston stroke axis
8. Peak
9. Passage opening
10. Cutout
11. Rounded transition
12. Threaded connection
13. Web
14. Cutout
15. Outer periphery

What is claimed is:

1. A piston assembled from an upper part, which has a cooling channel, and a lower part, which defines a pin bore, wherein the upper part and the lower part have mutually facing contact surfaces and the upper part and the lower part are held together by at least one threaded connection, characterized in that the lower part, starting from an inner region above a peak of the pin bore, defines a first cutout oriented in a direction of an outer periphery of the lower part, and starting from an outer region of the lower part, has at least one web positioned above the pin bore and also pointing in the direction of the outer periphery of the lower part, the at least one web positioned and operable to provide a contact support surface for the upper part on assembly of the upper part to the lower part.

2. The piston as claimed in claim 1 wherein the at least one web comprises a single web positioned above the peak of the pin bore.

3. The piston as claimed in claim 1 wherein the lower part further defines at least one second cutout positioned next to the at least one web.

4. The piston as claimed in claim 1 wherein the lower part further comprises a rounded region operable to transition the first cutout into the inner region of the lower part.

5. The piston as claimed in claim 1 wherein the lower part further defines a passage opening positioned above the first cutout and oriented in a direction of an inner region inside the upper part.

6. The piston as claimed in claim 5 wherein the lower part further comprises a rounded portion operable to transition the first cutout into the passage opening.

7. The piston according to claim 2 wherein the lower part further defines a second cutout positioned adjacent to the single web.

8. The piston according to claim 3 wherein the lower part further comprises a rounded region operable to transition the first cutout into the inner region of the lower part.

9. The piston as claimed in claim 3 wherein the lower part further defines a passage opening positioned above the first cutout and oriented in a direction of an inner region inside the upper part.

10. A piston for use in an internal combustion engine, the piston comprising:

an upper part extending along a stroke axis, the upper part having contact faces and defining an upper part inner region cavity;

a lower part extending along the stroke axis, the lower part further comprising:

contact faces in abutting contact with the upper part contact faces;

an outer periphery;

a pin hub defining a pin bore, the pin bore having an upper peak positioned at vertically highest portion of the pin bore parallel to the stroke axis;

a lower part inner region positioned vertically above the pin bore;

the lower part defining a first cutout positioned in the lower part inner region oriented in a direction of the outer periphery;

at least one web positioned vertically above the pin bore, the at least one web extending from the pin hub toward the outer periphery and operable to support the upper part; and a threaded connector operable to connect the lower part to the upper part.

11. The piston of claim 10 wherein the lower part further comprises a passage opening positioned above the first cutout and extending through the outer periphery.

12. The piston of claim 10 wherein the first cutout comprises a perimeter having a rounded edge.

13. The piston of claim 10 wherein the lower part further defines a second cutout adjacent at least one side of the at least one web.

14. The piston of claim 13 wherein the lower part defines the second cutout on both sides of the at least one web.

15. The piston of claim 10 further defining a shoulder positioned vertically lower than the outer periphery, the shoulder abuttingly engaging a portion of the upper part.

16. The piston of claim 10 wherein pin hub further comprises an outer exterior vertically oriented planar surface, the at least one web further comprising an outer exterior vertically oriented planar surface extending outwardly to the pin hub outer exterior vertically oriented planar surface.

17. The piston of claim 10 wherein the at least one web extends parallel to the piston stoke axis toward the lower part contact faces, the at least one web positioned and operable to abuttingly engage and support the upper part on assembly of the upper part to the lower part.

18. The piston of claim 10 wherein the at least one web comprises two webs laterally spaced apart from each other and extending parallel to the piston stroke axis.

* * * * *